United States Patent [19]

Harada et al.

[11] Patent Number: 4,939,867

[45] Date of Patent: Jul. 10, 1990

[54] POWER SUPPLYING SYSTEM FOR SELF-DRIVING CLOSURE DEVICE

[75] Inventors: Hiroyuki Harada, Hamamatsu; Kazuyoshi Kurahashi, Okazaki; Kengo Yamamura, Shizuoka; Youji Higuchi, Okazaki; Yasuhiro Fukatsu, Hamamatsu; Katsuhiko Torii, Shizuoka, all of Japan

[73] Assignees: Amso Co., Ltd., Shizuoka; Nippondenso Co., Ltd., Aichi, both of Japan

[21] Appl. No.: 387,276

[22] Filed: Jul. 31, 1989

[51] Int. Cl.[5] ..... E05F 15/16

[52] U.S. Cl. ..... 49/349; 49/358; 49/362

[58] Field of Search ..... 49/349, 362, 358

[56] References Cited

U.S. PATENT DOCUMENTS

| | | | |
|---|---|---|---|
| 3,240,484 | 3/1966 | Klamp | 49/358 X |
| 3,397,488 | 8/1968 | Goldstein | 49/358 X |
| 4,389,818 | 6/1983 | Sakamoto | 49/349 |

FOREIGN PATENT DOCUMENTS

| | | |
|---|---|---|
| 6068284 | 5/1985 | Japan . |
| 61-286485 | 12/1986 | Japan . |

*Primary Examiner*—Philip C. Kannan

*Attorney, Agent, or Firm*—Venable, Baetjer and Howard

[57] ABSTRACT

A power supplying system for supplying power to a self-driving closure device in which a driving source for driving the closure device for opening and closing an opening moves together with the closure device includes a lead wire having one end connected to a power source and the other end connected to the driving source. The side of the lead wire connected to the power source is supported at a midpoint between the positions of the upper and lower limits of movement of the driving source, while the side of the lead wire connected to the driving source is supported in such a manner as to move together with the driving source. The lead wire is thus made to swing in conjunction with the movement of the driving source so as to supply power to the moving driving source. A guide shaft is provided along the direction of movement of the driving source, and a helical portion formed in the lead wire is extended or shrunk along the guide shaft so as to supply power to the moving driving source.

20 Claims, 17 Drawing Sheets

POWER SUPPLYING SYSTEM FOR SELF-DRIVING CLOSURE DEVICE

BACKGROUND OF THE INVENTION

1. Field of the Invention

The present invention relates to a power supplying system for a self-driving closure device for driving a closure member, such as a window glass, sun-roof panel, etc. of an automobile or the like, in order to open and close the window or the roof opening. More specifically, the present invention relates to improvements of a power supplying system for a self-driving closure device in which a driving source for opening and closing the closure device is moved together with the closure member.

2. Statement of the Related Art

A power window regulator, which has become popular in recent years, for use on, for example, passenger cars, will be described as an example of the conventional self-driving closure device of this type.

This type of self-driving power window regulator has been used to replace the conventional X-arm system or wire-driven system in which the driving source is fixed to the door side. Such a power window regulator excels in that since a driving motor is moved together with the window glass, the number of components used can be reduced substantially, and that effective use can be made of the inner space of the door.

Proposals for this type of self-driving power window regulator are disclosed in, for instance, Japanese Utility Model Laid-Open No. 68284/1985 and Japanese Patent Laid Open No. 286485/1986, but the arrangement of Japanese Utility Model Laid-Open No. 68284/1985 will be described herein by way of example.

As shown in FIG. 28, the power window disclosed in this publication comprises a glass holder 12 fixed to the lower end of a window glass 10, a reversible motor 14 fixed to the glass holder 12, a pinion gear 18 rotatively driven by the motor 14 via a worm gear 16, and a rack 20 fixed vertically to an inner panel of the door and meshing with the pinion gear 18.

In accordance with this power window, since a system is adopted in which the window is driven by the rack 20 and the pinion gear 18, the number of parts used is small. In addition, since only the rack 20 is fixed vertically to the inner panel of the door, it is possible to make effective use of the inner space of the door.

However, with the above-described self-driving power window regulator, since the motor 14, i.e., a driving source for opening and closing the window glass 10 which is a closure member, moves together with the window glass 10, a lead wire, i.e., a cable, for supplying power to the motor 14 must also be arranged in such a manner as to be capable of moving freely with the motor 14 in the interior of the door.

Since various mechanical components exist in the door interior in addition to the mechanism for the power window, if a flexible lead wire for connecting the motor 14 to a battery moves without any restriction, there is a possibility that a malfunctioning can occur in various mechanisms. In addition, in such a case it is possible that the power window fails to function due to the damage of the lead wire.

However, no power supplying system has hitherto been proposed which is capable of supplying power to a movable driving source such as the one used for this type of self-driving power window without any trouble.

Partly due to this reason, this type of self-driving closure device has not been put to practical use.

SUMMARY OF THE INVENTION

Accordingly, an object of the present invention is to provide a power supplying system for a self-driving closure device in which the movement of a driving source does not cause any trouble in opening and closing a closure member and which is capable of smoothly effecting the movement of a lead wire within the limited space of the door interior.

To this end, in accordance with the present invention, there is provided a power supplying system for supplying power to a self-driving closure device in which a driving source for driving a closure member for opening and closing an opening moves together with the closure member so as to open and close the opening, the power supplying system comprising: a lead wire having one end connected to a power source and the other end connected to the driving source; first supporting means for supporting the side of the lead wire connected to the power source substantially at a midpoint between the positions of upper and lower limits of movement of the driving source; and second supporting means for supporting the side of the lead wire connected to the driving source in such a manner as to allow the side of the lead wire connected to the driving source to move together with the driving source. As a result, the lead wire is made swingable with a portion thereof supported by the first supporting means as a center as the driving source moves.

In the present invention, the lead wire is made to swing as the driving source moves, so that the supply of power from a fixed battery to a moving driving source via the lead wire is made possible. The center of the aforementioned swinging is a point located on a line perpendicular to and substantially bisecting the moving stroke of the driving source. Accordingly, a required minimum length of the lead wire is obtained when the driving source is located substantially in the center of the moving stroke, while a required maximum length of the lead wire is obtained when the driving source is located at each of the opposite ends of the path of movement thereof. The difference between the minimum length and the maximum length of the lead wire is substantially identical with the difference in length between the hypotenuse of a right-angled triangle and one of the other sides thereof. If the lead wire is provided with deflection at least by the portion of this difference, it is possible to prevent the trouble of the lead wire being cut off or other similar damage. The amount of deflection of the lead wire in accordance with the present invention can be made very small as compared with a case where, for example, the portion of the moving stoke of the driving source is required as deflection. As a result, the processing of this deflected portion can be facilitated, and it is possible to positively prevent the drawback of the deflected portion of the lead wire being caught by another mechanism due to the movement of the driving source.

To impart such deflection, it is the easiest way to form the lead wire helically, if such an arrangement is adopted, it is possible to apply a predetermined tension to the lead wire which swings and is displaced. Therefore, even if such a lead wire is used for, for instance, a power window of an automobile, the vibrations of the lead wire during running of the automobile can be reduced.

In addition, it is still difficult to completely prevent the vibrations by merely forming the lead wire into a helical configuration. Although the noises generated as a result can be suppressed by arranging a noise suppressing material on the inner panel of the door. As a more preferable measure, however, it is possible to provide a guide shaft for guiding the vibrating lead wire.

When the guide shaft is made to swing, since the driving source is normally made to move not arcuately but linearly with the aforementioned center of swinging as a center, it suffices if the moving end side of the guide shaft is made slidable in a direction perpendicular to the direction of movement of the driving source, or the guide shaft itself is made stretchable.

In addition, in accordance with another aspect of the invention, a power supplying system for a self-driving closure device comprises a lead wire having one end connected to a power source and the other end connected to the driving source, a stretchable helical portion being formed at an intermediate portion of the lead wire; fixing means for fixing a side of the helical portion connected to the power source; moving means for moving a side of the helical portion connected to the driving source together with the driving source while the diameter of the end of the helical portion connected to the driving source is being maintained in such a manner as not to become small; and guide means for guiding the helical portion which is moved by the moving means.

In accordance with the present invention, since the lead wire for supplying power to a driving source is formed helically, the lead wire is arranged to be stretchable. Even if the lead wire is extended or shrunk repeatedly, the lead wire can always be restored to its original helical state, so that there are no cases of the path of movement substantially changing on each such occasion, causing trouble to surrounding mechanisms.

Moreover, since the pitch of the helix is set to become minimum when the lead wire is shrunk, the space for accommodating the lead wire can be minimized, and the invention can therefore be effectively implemented in cases where the accommodation space is quite limited as in the case of the power window.

In addition, since the lead wire is moved together with the driving source by maintaining the diameter of the distal end side of the lead wire, the lead wire is preventing from being caught by the moving member for guiding the movement of the lead wire due to the shrinkage of the diameter, thereby making it possible to move the lead wire smoothly.

In other words, in a case where the movement guiding means is constituted by a guide shaft for guiding the helical lead wire by being inserted axially therethrough, the lead wire is moved along the guide shaft while maintaining the diameter of the distal end side of the lead wire. Hence, it is possible to positively overcome the problem of the lead wire being wound tightly around the guide shaft, hampering the smooth movement of the lead wire. Also, in a case where the movement guiding member is formed of a tubular member having a greater diameter than that of the helical lead wire, it is possible to ensure a smooth movement of the lead wire by means of this tubular member.

In addition, since the lead wire is thus guided by the movement guiding member, it is possible to positively prevent the drawback of the led wire coming into contact with another mechanical part during the extension or shrinkage of the lead wire.

In a case where the movement guiding member is formed as a guide shaft, as a measure for positively preventing the situation of the helical lead wire being tightly wound around the guide shaft, an arrangement is adopted in which the helical portion is coupled to a fixing member at specified intervals by means of coupling members, or annular members for maintaining the diameter of the helical portion are supported to the lead wire at specified intervals, thereby making it possible to positively prevent the drawback of an intermediate portion of the lead wire being tightly wound around the guide shaft.

As described above, in accordance with the present invention, in the self-driving closure device in which the driving source moves together with the closure device, the lead wire for supplying power to the moving driving source can be made to swing smoothly by following the movement of the driving source, and it is therefore possible to provide a power supplying system which is capable of positively preventing the drawback of the lead wire being caught by a surrounding mechanism and becoming disconnected as a result.

DESCRIPTION OF THE PREFERRED EMBODIMENTS

Referring now to the accompanying drawings, a specific description will be given of embodiments in which the present invention is applied to a self-driving power window regulator.

First Embodiment

Figure 1:
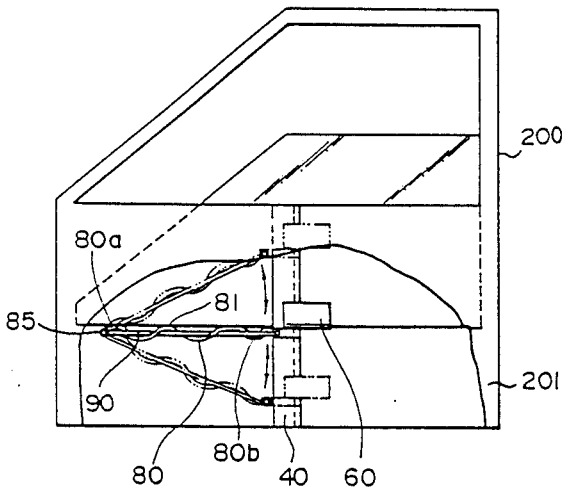
FIG. 1 is a schematic diagram illustrating a power supplying system for a self-driving closure device in accordance with a first embodiment of the present invention.

As shown in FIG. 1, a power supplying system in accordance with a first embodiment is arranged as follows: One end 80a of a lead wire 80 for supplying power to a self-driving power window motor 60 is supported at one point (corresponding to a rotary supporting piece 85 which will be described later) located on a line perpendicular to the moving stroke of the motor 60 and substantially bisecting said stroke, i.e., at a midpoint between the position of the upper limit of the motor 60 and the position of the lower limit thereof. The other end, i.e., a moving end 80b, of the lead wire 80 is connected to the motor 60. The lead wire 80 is made swingable with the aforementioned one point on the perpendicular line as the motor 60 moves. In addition, there are provided a guide shaft 90 which is rotatively supported at the aforementioned one point on the perpendicular line and at the motor 60 side and adapted to support the lead wire 80, as well as a sliding support member 100 (see FIG. 2) which is secured to the motor 60 side and adapted to slidably support a rotary supporting member of the guide shaft 80 in a direction perpendicular to the direction of movement of the motor 60.

Figure 2:
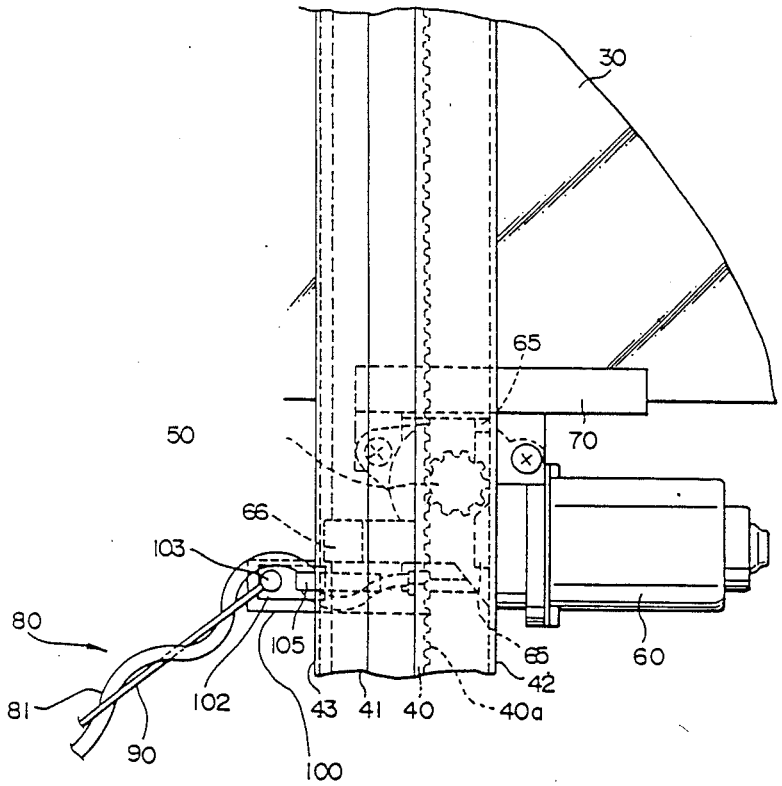
FIG. 2 is a front elevational view of the mechanism of a power window to which the present invention is applied.
Figure 3:
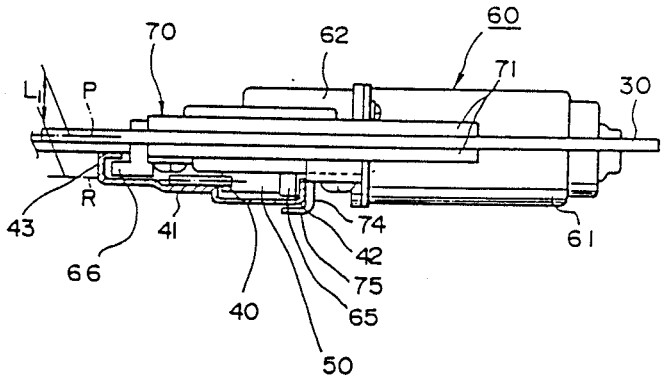
FIG. 3 is a top plan view of that mechanism.

As shown in FIGS. 2 and 3, a power window, which is a self-driving closure device, comprises a rack 40 fixedly supported along a path of movement of a window glass 30, i.e., a closure member for opening and closing an opening of the window, a pinion gear 50 meshing with the rack 40; a motor 60 for rotatively driving the pinion gear 50 in a reversible manner; and a support member 70 for supporting and fixing the motor 60 to the lower end of the window glass 30.

The rack 40 has teeth 40a in a direction perpendicular to the direction of movement of the window glass 30, i.e., in the breadthwise direction of the window glass 30, and is secured to a rack mounting bracket (hereinafter referred to as the bracket). The rack 40 and the bracket 41 are curved with substantially the same curvature as that of the curved window glass 30. In addition, the bracket 41 is secured by tightening a pair of U-shaped mounting pieces 41a formed at upper and lower ends of the bracket 41, respectively, onto an inner panel 32 of the door by means of a pair of bolts 33 (see FIG. 4).

The bracket 41 has at its opposite ends in its breadthwise direction a pair of hook-shaped engaging portions 42, 43 which are adapted to be retained by first and second engaging projections 65, 66 which will be described later.

The motor 60 comprises a motor body 61 and a gear housing unit 62 secured to the motor body 61.

Figure 4:
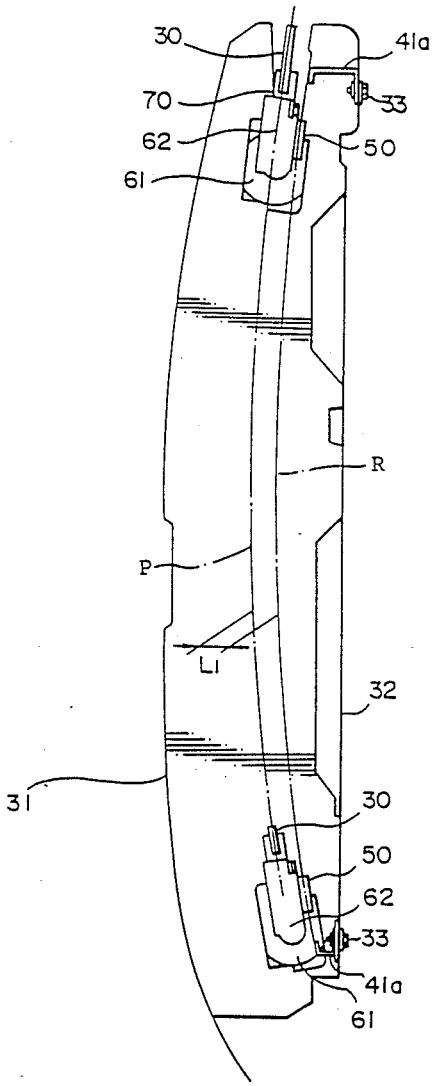
FIG. 4 is a schematic diagram illustrating the path of movement within a door interior.
Figure 5:
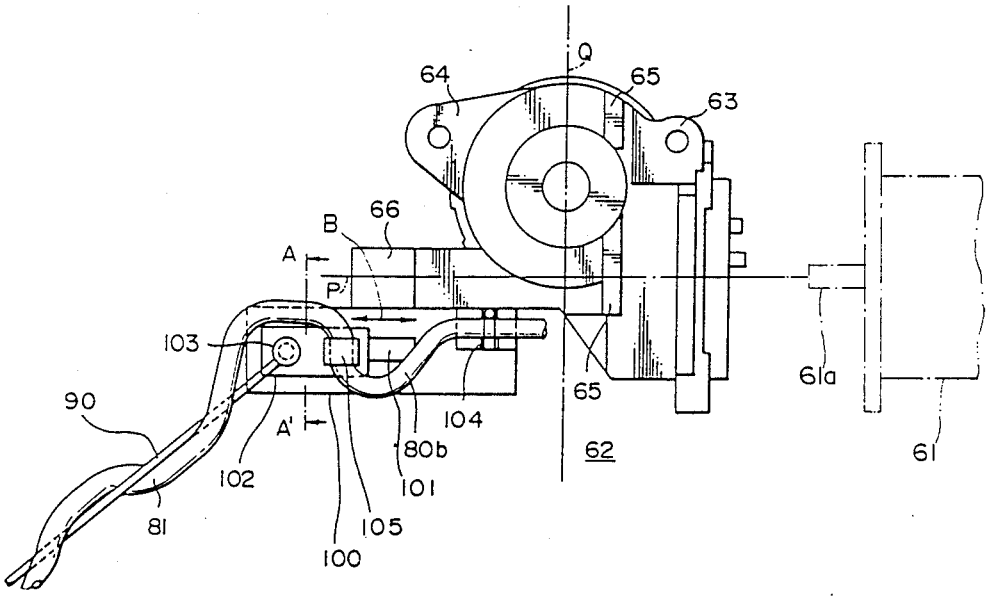
FIG. 5 is a diagram illustrating how a lead wire is supported on a driving source side in accordance with the first embodiment.

An output shaft 61a of the motor body 61 is disposed in alignment with line P shown in FIG. 3, as indicated by an alternate long and short dash line in FIG. 5, and this line P is also in alignment with the center-of-gravity line of the motor body 61. Furthermore, as also shown in FIG. 4, this line P is in substantially the same plane as the plane of movement of the window glass 30, and is located in the vicinity of a lower portion of the window glass 30.

The gear housing unit 62 is adapted to decelerate the output of the motor body 61 and transmit the same to the pinion gear 50 having an axis of rotation in a direction perpendicular to the aforementioned line P, i.e., in a direction perpendicular to the motor shaft.

To give a more detailed description of the gear housing unit 62, the gear housing unit 62 has a member for fixing the motor body 61 to the support member 70 and a member for positioning the bracket 41. In other words, as shown in FIG. 5, a pair of mounting pieces 63, 64 for mounting the gear housing unit 62 to the support member 70 are formed on the upper side of the gear housing unit 62, and the first engaging projection 65 for retaining one engaging portion 42 of the bracket 41 is also formed thereon (see FIG. 2 as well). In addition, the second engaging projection 66 for retaining the other engaging portion 43 of the bracket 41 is formed at one end of the gear housing unit 62 extending in such a manner as to be aligned with the aforementioned line P.

In addition, the gear housing is provided with the sliding support member 100 for clamping the moving end 80b of the lead wire 80 for supplying power to the motor body 61 and for slidably supporting one end of the guide shaft 90. A detailed description of the sliding support member will be given later. Incidentally, line Q in FIG. 5 indicates a central line of the pinion gear 50.

A description will now be given of the support member 70 with specific reference to FIGS. 6(A) and 6(B).

This support member 70 comprises a clamp 71 for clamping the lower end of the window glass 30 and being bonded thereto by means of, for instance, an adhesive; a pair of fixing portions 72, 73 for fixing the motor 60 via the gear housing unit 62; a vertical surface 74 formed by orthogonally bending an edge portion of one fixing portion 73; and a parallel surface 75 formed during assembly in such a manner as to be parallel with the window glass 30. The fixing portion 72 is secured to the mounting piece 64 of the gear housing unit, while the fixing portion 73 is secured to the mounting piece 63 of the gear housing unit.

As the motor 60 is mounted on the window glass 30 by this support member 70, as shown in FIG. 3, when this mechanism is viewed from the moving end of the window glass 30, line P aligned with the output shaft 61a of the motor 60 is also aligned with the central line of the window glass 30 in its widthwise direction.

The assembling of the support member 70 is effected in such a manner that one engaging portion 42 of the bracket 41 is first inserted between the vertical surface 74 and the first engaging projection 65 formed on the gear housing unit 62, and then the parallel surface 75 is arranged to cover the outside of the engaging portion 42, as shown in FIG. 3.

Figure 6A:
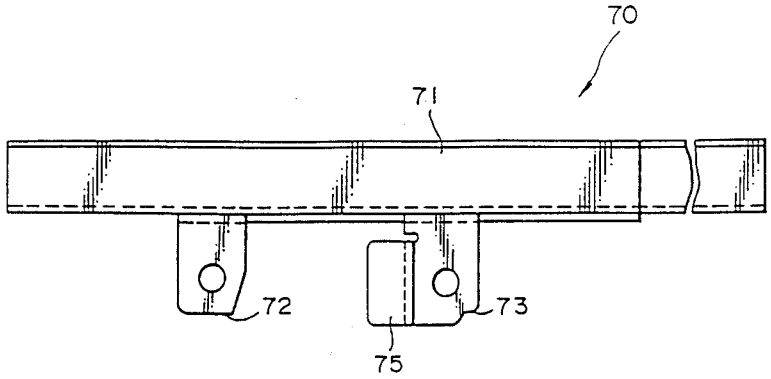
FIGS. 6A and 6B are a front elevational view and a side elevational view of a support member, respectively.
Figure 6B:
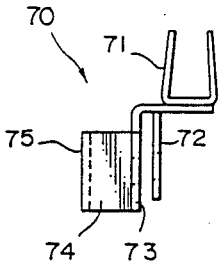
Figure 6C:
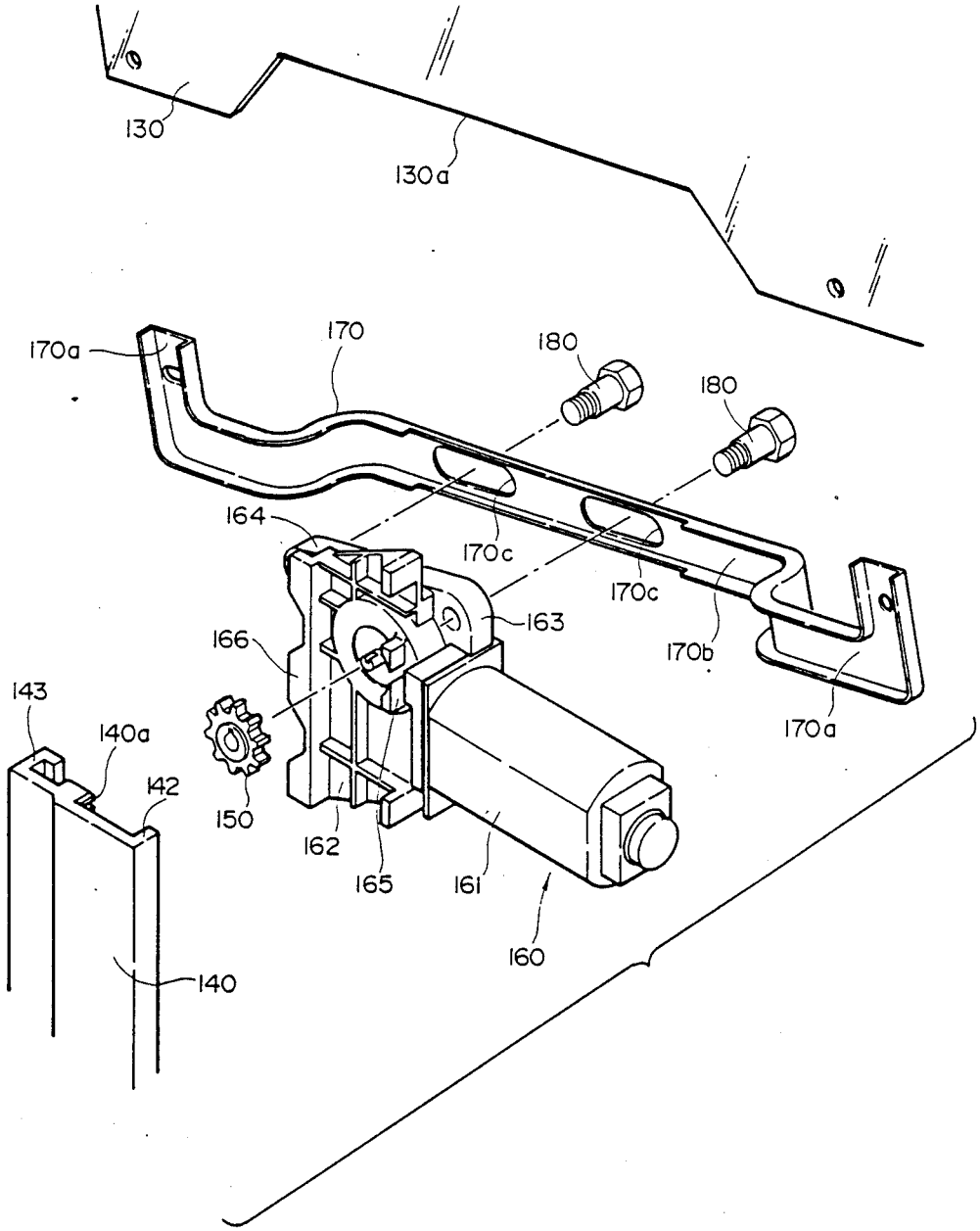
FIG. 6C is an exploded perspective view of another example of the support member.

Referring now to FIG. 6C, a description will be given of another example in which the motor is mounted on the window glass.

A recess 130a is formed at a lower end surface of a window glass 130 at an intermediate portion thereof in its breadthwise direction. A support member 170 is constituted by an elongated member in the form of a channel. This support member 170 has at its opposite ends a pair of bent portions 170a extending in the direction of the window glass 130 (i.e., upwardly). The support member 170 is fixed to the window glass 130 by superposing the bent portions 170a on one surface of the window glass 130 at the lower end thereof and securing the same by means of unillustrated mounting members such as screws. In addition, a longitudinally intermediate portion of the support member 170 has a U-shaped projection 170b formed by being bent in such a manner as to extend from one side to the other side of the window glass 130 in correspondence with the recess 130a. A space defined by the inner side of this projection 170b and the recess 130a serves as a space for accommodating a motor 160. A pair of slits 170c extending in the longitudinal direction of the support member 170 are formed at the bottom of the projection 170b.

The motor 160 includes a motor body 161 and a gear housing unit 162 secured to the motor body 161 in the same way as the example described above.

The gear housing unit 162 has a pair of mounting pieces 163, 164 for mounting the motor body 161 on the support member 170, and a first engaging projection 165 and a second engaging projection 166 are formed thereon in a projecting manner.

Meanwhile, a rack 140 includes the following: a teeth portion 140a for meshing with a pinion gear 150 rotatively driven by the motor 160 reversibly; an engaging portion 142 into which the first engaging projection 165 is inserted in correspondence with the first engaging projection 165; and a U-shaped engaging portion 143 in which the second engaging projection 166 is accommodated, the engaging portions 142, 143 being disposed at opposite ends of the rack 140 in its breadthwise direction.

Accordingly, with the pinion gear 150 meshing with the teeth portion 140a of the rack 140, the movement of the pinion gear 150 in the breadthwise direction of the window glass 130 is restricted by the first engaging projection 165 and the engaging portion 142, while the movement of the pinion gear 150 in the direction of the thickness of the window glass 130 is restricted by the second engaging projection 166 and the engaging portion 143, so as to ensure that a meshing condition between the pinion gear 150 and the rack 140 can be maintained positively.

A description will now be given of the assembling of the motor 160 to the support member 170.

The motor 160 is positioned at the projection 170b of the support member 170, and the slits 170c are arranged facing the mounting pieces 163, 164.

The motor 160 is position at the projection 170b of the support member 170, and the slits 170c and the mounting pieces 163, 164 are made to oppose each other.

Then, the motor 160 and the support member 170 are fixed by means of a pair of screws 180 in such a manner that the output shaft of the motor body 161 (the center of gravity of the motor 160) is substantially aligned with the path of movement of the window glass 130 to which the support member 170 is fixed, i.e., the control line of the window glass 130 in the direction of its thickness (line P in FIG. 4). Incidentally, the position of the motor 160 in the broadthwise direction of the window glass 130 can be adjusted by means of the slits 170c.

Since this embodiment is thus arranged, the angular moment exerted on the window glass 130 can be reduced substantially as compared with the prior art.

In addition, since the center of gravity of the motor 160 is in alignment with the central line of the window glass 130 in the direction of its thickness, the eccentric load applied to the window glass 130 can be reduced appreciably.

A description will now be given of the power supplying system for supplying power to the motor 60 for the above-described self-driving power window.

As shown in FIG. 1, this power supplying system is arranged such that the one end 80a of the lead wire 80 connected to the battery side is supported by an inner panel 201 of a door 200, while the moving end 80b of the lead wire 80, i.e., the other end thereof, in connected to the motor 60, and an intermediate portion of the lead wire 80 is formed as a helical portion 81 so as to enable the supply of power to the motor 60.

Figure 7:
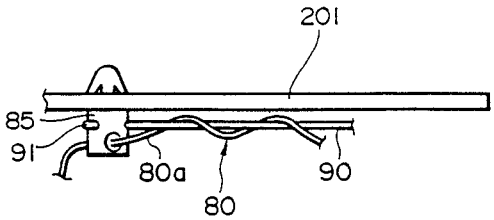
FIG. 7 is a schematic diagram illustrating an inner panel-side guide shaft support.
Figure 8:
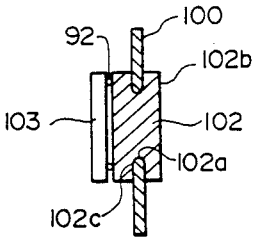
FIG. 8 is a cross-sectional view taken along the line A–A of FIG. 5, illustrating a motor-side guide shaft support.

A supporting point of the lead wire to the inner panel 201 is disposed on a line perpendicular to the moving stroke of the motor 60 and substantially bisecting the moving stroke, and is spaced apart from the line of movement of the motor 60 as practically as far as possible. This supporting point is provided at a midpoint between the position of the upper limit and the position of the lower limit of the moving stroke of the motor. In addition, a guide shaft 90 is provided in which, as shown in FIG. 7, a hook portion 91 at one end thereof is rotatably supported by the rotary supporting piece 85 supported by the inner panel 201 by means of elastic deformation, and, as shown in FIG. 8, a hook portion 92 at the other end thereof is rotatably supported by a slider 102 of the sliding support member 100. The helical portion 81 of the lead wire is guided and supported helically by this guide shaft 90. The end 80a of the lead wire 80 is inserted into a through hole bored in the rotary supporting piece 85 so as to be supported.

The sliding support member 100 has a rectangular elongated hole 101 whose longitudinal direction is the direction perpendicular to the direction of movement of the motor 60. The slide 102 which is fitted in this elongated hole 101 is slidable in the direction of arrow B in FIG. 5. In addition, on the side of the sliding support member 100 close to the motor body 61, the lead wire 80 is fixed by a detachable first clamper 104 shown in FIG. 16.

As shown in FIG. 8, which is a cross-sectional view taken along the line A—A of FIG. 5, the slider 102 has a sectional configuration formed by a short-width portion 102a, which has a shorter width than the length of the short side of the elongated hole 101, and a pair of large-width portions 102b, 102c provided on both sides of the short-width portion 102a. As the slider 102 is fitted in the elongated hole 101, as shown in FIG. 8, the slider 102 is permitted to move only in the longitudinal direction of the elongated hole 101. In order to realize a fitting form such as the one shown in FIG. 8, it suffices if the slider 102 is formed into a two-piece structure which can be split on both sides of the sliding support member 100, or if a hole portion allowing the entire slider 102 to be inserted therethrough is formed outside the range of the effective sliding stroke of the slider 102 in such a manner as to communicate with the elongated hole 101, the slider 102 is then temporarily inserted in this hole portion up to the center of its thickness, and the slider 102 is subsequently moved so as to be fitted in the elongated hole 101.

In addition, provided on the large-width portion **102*b* of the slider 102 is a drum-shaped rotary supporting member 103 for rotatively supporting the hook portion 92 formed at one end of the guide shaft 90. Furthermore, a detachable second clamper 105 is also provided on the large-width portion 102*b***.

Figure 16:
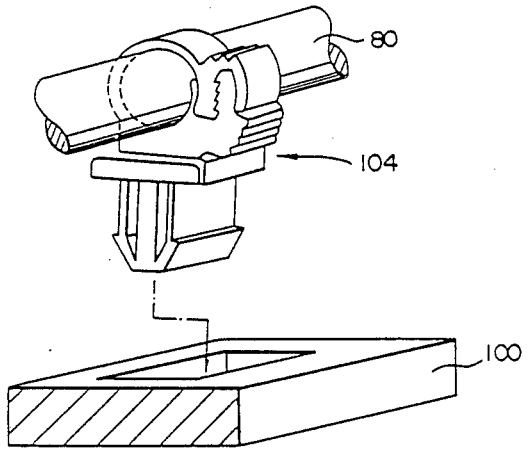
FIG. 16 is a schematic perspective view of an example of a clamper of the lead wire.

The lead wire 80 after being connected to the motor body 61 is first clamped by the first clamper 104 which is mounted on the sliding support member 100 through elastic deformation as shown in FIG. 16. Then, the lead wire 80 is clamped by the second clamper 105 which is mounted on the slider 102 through elastic deformation. It should be noted that since the second clamper 105 slides together with the slider 102, the portion of the lead wire 80 between the first and second clampers 104, 105 is provided with adequate deflection.

A description will now be given of the operation of the above-described power window.

In terms of the driving principle of this power window, in the same manner as the self-driving power window based on the conventional rack-and-pinion system, the output of the motor body 61 is decelerated by the gears of the gear housing unit 62, and is then transmitted to the pinion gear 50 having an axis of rotation in a direction perpendicular to the output shaft of the motor body 61.

When this driving force is transmitted, the pinion gear 50 rotates while being meshed with the rack 40. Since the rack 40 is secured to the inner panel 201 of the door via the bracket 41 and the mounting piece **41*a*, the pinion gear 50 moves along the rack 40 as the pinion gear 50** rotates.

Since the pinion gear 50 is supported integrally with the motor 60, support member 70, and window glass 30, i.e., the closure member, these members move as a unit together with the pinion gear 50. Hence, as the motor 60 is rotatively driven forwardly and backwardly, it is possible to move the window glass 30 in the opening and closing direction.

Thus, with the self-driving power window, the motor body 61 moves together with the window glass 30 which is the closure member.

For this reason, the power supplying system for supplying power to the moving motor body 61 operates in the following manner so as to supply power to the motor body 61.

The moving end **80*b* of the lead wire 80 connected to the motor body 61 is supported by the sliding support member 100 formed on the gear housing unit 62 moving together with the motor body 61. To give a more detailed description, the lead wire 80 is clamped by the first and second clampers 104, 105** with certain deflection provided therebetween.

If the window is moved, for instance, from the lowermost end by the driving of the motor 60, the motor 60 moves from the state of the two-dotted chain line at the lowermost end to the state of the two-dotted chain line at the uppermost end via the state of the solid line at its neutral position in FIG. 1. At this juncture, the lead wire 80 is supported by the guide shaft 90, and swings about the rotary supporting piece 85 of the inner panel 201.

In this case, the motor 60 moves linearly along the rack 40, while the guide shaft 90 swings. To secure this swinging, therefore, the slider 102 slides along the elongated hole 101 of the sliding support member 100, with the result that the swinging of the guide shaft 90 is made possible.

As the lead wire 80 swings, the length of the helical portion 81 helically wound around the guide shaft 90 is unchanged, and as the lead wire 80 is deflected by the portion of the sliding movement of the slider 102, the lead wire 80 can follow the movement of the motor 60.

The amount of deflection at this time can be made the shortest as the center of swinging located at the position of the rotary supporting piece 85 is disposed on the line perpendicular to the moving stroke of the motor 60 and substantially bisecting that stroke. For this reason, the amount of deflection can be set sufficiently by causing the lead wire 80 to be deflected between the first and second clampers 104, 105. Since the amount of deflection is small, the possibility of the movement of this portion interfering with the other mechanisms is very, so that it is possible to arrange a window regulator which experiences very little trouble.

In this embodiment, the moving stroke of the motor 60 and the length of the guide shaft are set at about 400 mm, and the amount of movement of the slider 102 is about 40 mm.

As shown in FIG. 1, the window glass 30 in many cases has a substantially trapezoidal configuration, and it is preferred in terms of driving efficiency that the rack 40 be formed parallel with a vertical line passing through the center of gravity of this window glass 30. If this arrangement is adopted, it is possible to increase the length between the fulcrum of swinging on the left-hand side in FIG. 1, i.e., the position of the rotary supporting piece 85, and the path of movement of the motor 60, and the longer the length of the guide shaft 90, the more the amount of movement of the slider with respect to an identical swinging angle, i.e., the amount of deflection of the lead wire, can be reduced.

In addition, in the above-described embodiment, the helical portion 81 is for allowing the lead wire to be supported easily by the guide shaft 90, and this helical portion 85 is not pulled. Therefore, the helical portion 85 may be supported to the guide shaft 90 by means of, for instance, a clamper. To protect the helical portion, the helical portion may be covered with a tubular member.

Second Embodiment

A second embodiment of the invention has a guide shaft for supporting the lead wire in the same way as the first embodiment. However, the moving end at the guide shaft is not made slidable, and the guide shaft itself is made flexible so as to permit the swinging of the guide shaft and the lead wire 80. Since the power window is arranged in the same way as the first embodiment, a detailed description thereof will be omitted.

Figure 9:
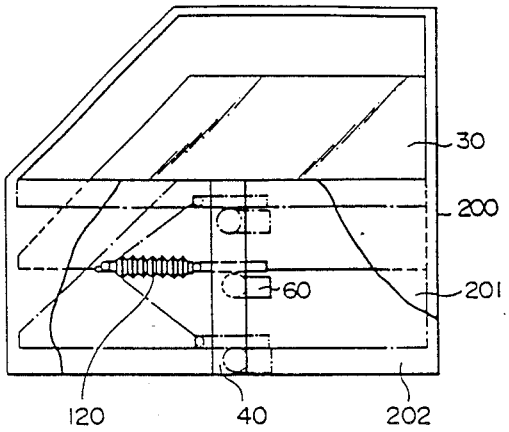
FIG. 9 is a schematic diagram illustrating a second embodiment of the present invention.
Figure 10:
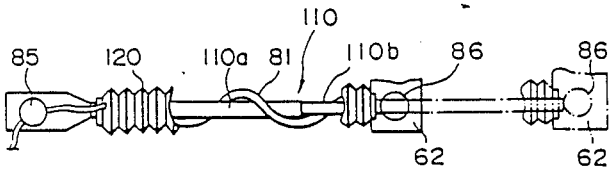
FIG. 10 is a schematic diagram illustrating a flexible guide shaft.
Figure 11:
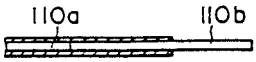
FIG. 11 is a cross-sectional view of the flexible guide shaft.

In other words, in this second embodiment, the arrangement of major members shown in FIG. 9 is similar to that of the first embodiment. However, a guide shaft 110 has an arrangement in which a small-diameter shaft **110*b* is connected to a large-diameter hollow shaft 110*a* by inserting the former into the latter, as shown in FIGS. 10 and 11. The helical portion 91 of the lead wire 80 is round around the periphery thereof. The fixed end of the guide shaft 110 is rotatably supported by the inner panel 201 side by a rotary supporting member 85 in the same way as the first embodiment, while the moving end thereof is rotatably supported by a rotary supporting member 86 fixed to a port of the gear housing 62**.

Furthermore, there is provided a bellows member 120 which has opposite ends respectively fixed to the opposite ends of the guide shaft 110 and surrounds both the guide shaft and the the helical portion 81 of the lead wire 80.

In this second embodiment, since the swinging of the guide shaft 110 to follow the movement of the motor 60 is made possible by telescopically extending the guide shaft 110 itself, the arrangement for making the moving end side of the guide shaft slidable is dispensed with. In addition, since the length of the lead wire 80 between supporting points at the opposite ends thereof varies by following the extension or shrinkage of the guide shaft 110, the lead wire 80 is provided with deflection by the extending and shrinking action of the spiral portion 81, thereby preventing the lead wire 80 from being pulled excessively.

The bellows member 120 is designed to protect the lead wire 80 which swings by following the upward and downward movement of the motor 60, and bellows member 120 ensures a smooth extending and shrinking operation of the guide shaft 110 by preventing the dust and rainwater from attaching to the guide shaft 110. Additionally, the bellows member 120 also has the function of imparting the smooth movement of the respective parts of the bellows member 120 ot the lead wire 80 through frictional contact so that the entire helical portion 81 will be extended or shrunk by following the telescopic movement of the guide shaft 110.

Thus, in accordance with the above-described first and second embodiments, since the swinging of the load wire 80 is guided by the guide shaft 110, there is no possibility of the lead wire 80 coming into contact with other mechanisms between the door panels 201, 202 during the driving of the power window. In addition, the generation of abnormal noises caused by the vibrations of the lead wire 80 during the running of the vehicle can be prevented positively.

Third Embodiment

A third embodiment of the invention has an arrangement which can realize the present invention in the simplest manner, and does not require the guide shafts 90, 110 used in the aforementioned embodiments. Specifically, an shown in FIG. 12, an arrangement is provided such that the helical portion 81 of the lead wire 80 is provided extending between a supporting piece 87 fixed to the inner panel 201 and a supporting piece 88 fixed to the gear housing unit 62. It should be noted that since the power window in this embodiment is identical with that of the first embodiment, a detailed description thereof will be omitted.

Figure 13:
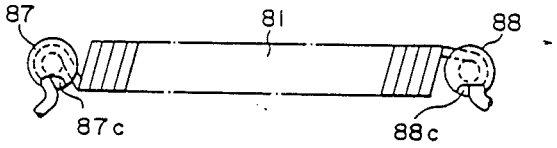
FIG. 13 is a schematic diagram of a helical lead wire used in the third embodiment.
Figure 14:
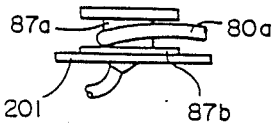
FIGS. 14 and 15 are schematic diagrams illustrating supporting pieces respectively provided at the opposite ends of the helical lead wire.
Figure 15:
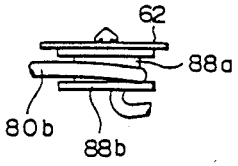

The supporting piece 87 fixed to the inner panel 201 is so secured through elastic deformation, as shown in FIGS. 13 and 14, and one end 80*a* of the lead wire 80 is round around a drum 87*a*, the lead wire 80 being inserted into a hole 87*c* formed in a side surface 87*b* thereof so as to be supported.

The supporting piece 88 fixed to the gear housing 62 has a similar arrangement, and, as shown in FIGS. 13 and 14, the moving end side of the lead wire 80 is wound around a drum 88*a*, and the lead wire 80 is inserted into a hole 88*c* formed in a side surface 88*b* thereof so as to be supported.

Figure 12:
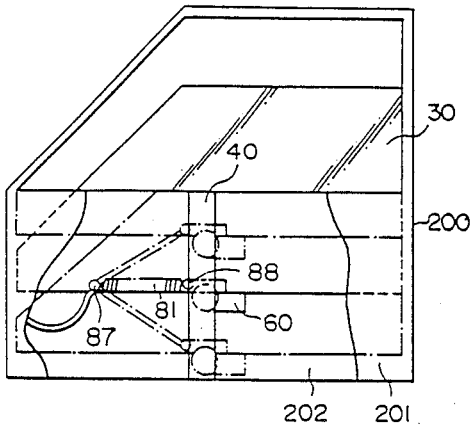
FIG. 12 is a schematic diagram illustrating a third embodiment of the present invention.

Even though such a simple arrangement is adopted, it is possible to cause the lead wire 80 to swing by the extension or shringkage of the helical portion 81 of the lead wire when the window regulator is driven, as shown in FIG. 12.

At this juncture, the rigidity of the helical portion 81 can be increased by selecting a material of the lead wire appropriately, or it is possible to enhance its rigidity by helically forming the lead wire 80 together with a sensor output cable or the like for realizing additional functions based on motor drive. Through the adoption of such a meausre, tension can be provided between the driving side and the power source side of the lead wire 80, with the result that the vibrations of the lead wire 80 can be minimized, thereby reducing the generation of abnormal noises. Also, a noise suppressing material may be formed on the door panels 201, 202.

In the embodiments described above, the arrangement is provided such that, when viewed from the moving end side of the window glass 30, the output shaft of the motor body 61 (which is aligned with central line P) is in alignment with the central line in the direction of the thickness of the window glass 30. Accordingly, distance L1 between the central line of the window glass 30 (i.e., central line P) which is the closure member and the central line of the rack and pinion assembly (line R shown in FIGS. 3 and 4) for producing a driving force for vertically driving the window glass 30 can be made far shorter than the conventional rack-and-pinion system.

As a result, angular moment acting on the window glass in proportion to the aforementioned distance can be reduced substantially as compared with the conventional arrangement, and a frictional force acting on a window frame during the opening or closing thereof can be reduced. Accordingly, there is the advantage that it is possible to ensure an efficient and positive opening and closing operation by arranging the motor 60 having a smaller torque than a conventional one.

Generally, the door of a vehicle is curved, and the path of movement of the motor 60 is also curved, as shown in FIG. 4. for this reason, it is preferred that the rotary supporting points at the opposite ends of the guide shaft 90 or 110 in the above-described embodiments support the guide shaft 90 or 110 with a certain degree of freedom in the directin of the thickness of the door. Thus, it is preferred that the drum around which the hook portion at each opposite end of the guide shaft be formed into a configuration having a leeway in its thickness in the direction of the door, or a universal joint or the like be adopted.

Figure 17:
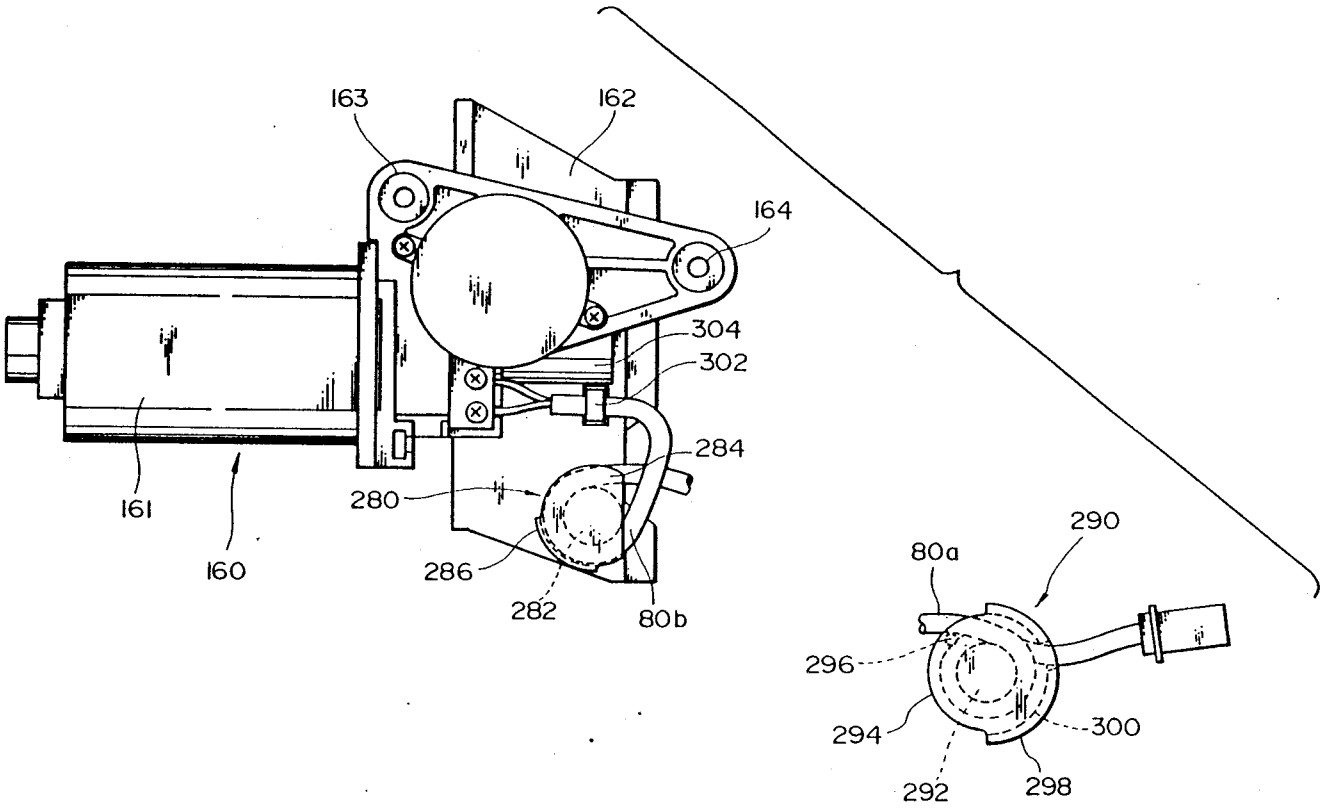
FIG. 17 is a schematic diagram illustrating another example of the support pieces at the opposite ends of the lead wire.

Referring now to FIG. 17, a description will be given of anothe example of a method of mounting one end (fixed end) 80*a* and the moving end 80*b* of the lead wire in accordance with the third embodiment. In FIG. 17, parts that are identical with those shown in FIG. 6C are denoted by the same reference numerals, and a detailed description thereof will be omitted. A supporting piece 280 is fixed to a lower end of the gear housing unit 162 on the side of a door chassis 31 (See FIG. 4). This supporting piece 280 has a drum 282, a flange 284 fixed to the drum 282, and a projecting wall 286 projecting from the flange 284 in the direction of the gear housing until 162 in parallel with the outer periphery of the drum 282. The moving end 80*b* of the lead wire 80 is clamped by the outer periphery of the drum 282 and the inner periphery of the projecting wall 286 and is wound around the outer periphery of the drum 282 by one turn so as to be supported. A supporting piece 290 is secured to the inner panel of the door. This supporting piece 290 has a drum 292 and a flange 294 fixed to the drum 292. The flange 294 has a pin 296 projecting in the direction of the inner panel in parallel with the shaft of the drum 292 as well as a projecting wall 298 projecting in the direction of the inner panel in parallel with the outer periphery of the drum. A notch 300 extending in the peripheral direction of the drum is formed in this projecting wall 298. The fixed end 80*a* of the lead wire for connection with the battery is inserted into the notch 300, is clamped by the outer periphery of the drum and the inner periphery of the projecting wall as well as the outer periphery of the drum and the outer periphery of the pin 296, is then wound by about one turn, and is made to project between the pin 296 and the projecting wall 298. A clamp 302 fixes the load wire so that the lead wire will not be directly pulled by the motor body 161.

Fourth Embodiment

Figure 18:
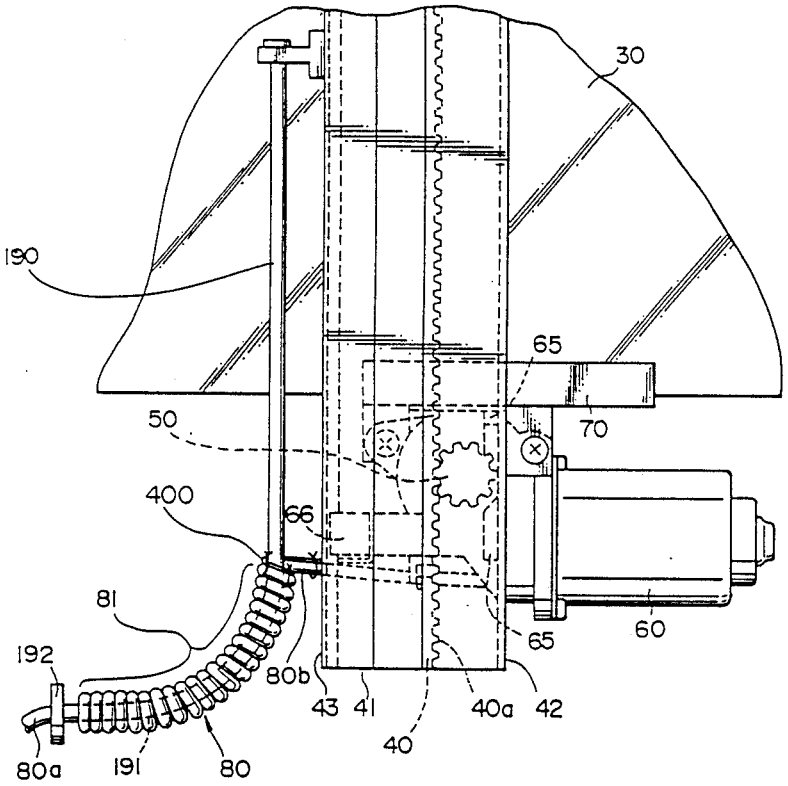
FIG. 18 is front elevational view of the mechanism of a power window to which a fourth embodiment of the present invention is applied.
Figure 19:
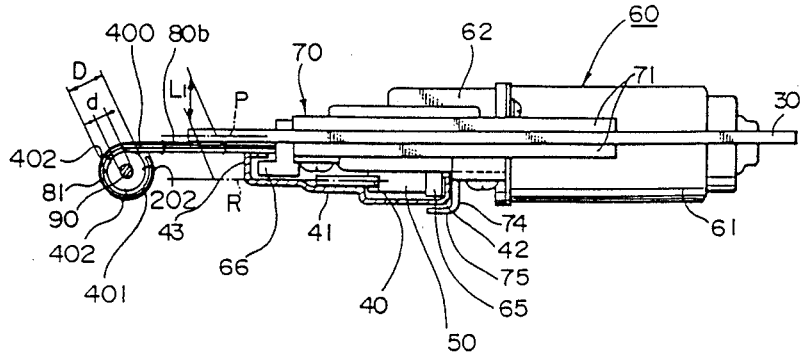
FIG. 19 is a top plan view of that mechanism.
Figure 20:
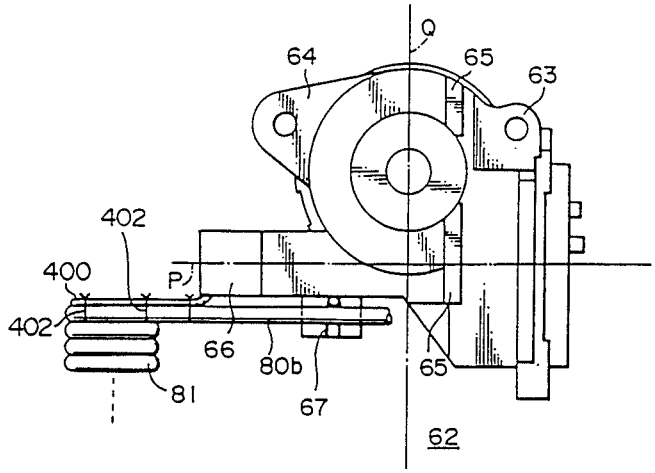
FIG. 20 is a diagram illustrating how a lead wire is supported on the driving source side in accordance with the fourth embodiment.

Referring specifically to FIGS. 18, 19 and 20, a detailed description will be given of a fourth embodiment of the present invention. Since the power window to which the present invention is applied is identical with the power window of the first embodiment, corresponding parts will be denoted by the same reference numerals and a detailed description thereof will be omitted.

As shown in FIGS. 18, 19 and 20, a clamper 67 for clamping the moving end 80*b* of the lead wire 80 for supplying power to the motor body 61 is disposed at the lower end of the gear housing unit 62. In addition, a moving member 400 for moving the moving end 80*b* of the lead wire 80 together with the motor body 61 is secured to the gear housing unit 62. A detailed description will be given of the moving member 400.

It should be noted that, as the support member 70, the one shown in FIGS. 6A, 6B and 6C may be used.

Referring now to FIG. 18, a description will be given of a power supplying device for supplying power to the motor body 61 of the power window.

This power supplying system comprises the lead wire 80 having one end 80*a* connected to a battery mounted on a vehicle secured to the interior of the door, the other end 80*b* thereof connected to the motor body 61, and an intermediate portion formed as the helical portion 81; and a guide shaft 190, i.e., an example of a movement guiding member which is inserted axially through the helical portion 81 of the lead wire 80 and formed along the direction of movement of the motor 60; and the moving member 400 for moving the upper end of the helical portion 81 of the lead wire 80 together with the motor 60 while maintaining the diameter of the helix.

The relationship between the lead wire 80 and the moving member 400 will be described with reference to FIGS. 18 and 19. As illustrated in the drawings, the distal end of the moving member 400 has a curled portion 401 having substantially the same diameter as that of the helical portion 81 when it is shrunk, while the other end of the moving member 400 is secured to the gear housing unit 62.

In addition, the lead wire 80 after being connected to the motor body 61 is first clamped by the clamper 67 provided on the gear housing unit 62, and is clamped by clampers 402 at appropriate portions along the moving member 400, thereby allowing the moving end 80*b* of the lead wire 80 to be supported by the moving member 400.

The guide shaft 190 is formed with a rod-shaped member having diameter d, and the upper end thereof is secured to the bracket 41, while the other end thereof is curved into a curved portion 191 and is secured to the door. A stopper 192 is used for preventing the lead wire 80 from coming off.

A description will be given of the relationship between diameter d of the guide shaft 190 and inside diameter D of the helical portion 81 of the lead wire 80. As a condition for preventing the helical portion 81 from being wound too tightly around the guide shaft 80, it suffices if the following formula is met $$(D \cdot d) \times \pi \times T > L$$

where L is the stroke (length) of movement of the motor body 61, and T is the number of helical turns.

Furthermore, the overall length l of the lead wire 80 necessary for forming the helical portion 81 can be determined from the following formula on the basis of the inside diameter D of the helical portion 81 of the lead wire 80 obtained by the aforementioned formula:

$$t \times \pi D = 1$$

The operation of the above-described power window will be described hereinunder. In this self-driving power window, the motor body 61 also moves together with the window glass 30 which is the closure member, as described with respect to the first embodiment.

Accordingly, the power supplying system for supplying power to the motor body 61 operates as described below, so as to supply power to the motor body 61.

The connecting end 80*b* of the lead wire 80 for connection with the motor body 61 is supported by the moving member 400 secured to the gear housing 62 which moves together with the motor body 61. Accordingly, the moving member 400 also moves in interlinking relation with the movement of the motor body 61, and the moving end 80*b* of the lead wire 80 is hence moved.

Meanwhile, since the intermediate portion of the lead wire 80 is formed as the helical portion 81, and when the motor body 61 is located at its lowermost position, the helical portion 81 is accommodated in a shrunk state so that the pitch of the helix becomes minimum, as shown in FIG. 18, while when the moving member 400 is raised, the helcial portion 81 is ectended along the longitudinal direction of the guide shaft 190 so as to be capable of following the movement of the motor body 61. It should be noted that, with respect to the shrinkage of the lead wire 80, since the resiliency of a core of this wire (a core having a diameter of about 1.25 mm is used in this embodiment) acts, the restoration of the helical portion 81 is made easy. If the resiliency of the lead wire alone is not sufficient, an additional core may be disposed in the wire so as to enhance the resiliency.

Thus, as the lead wire 80 is formed helically, the lead wire 80 is arranged to be stretchable, and it is possible to accommodate the same without deflection when it is shrunk, making the accommodation space at that time minimum.

In addition, since the guide shaft 190, i.e., the movement guiding member, is inserted axially through the helical portion 81, the helical portion 81 moves while being guided by the guide shaft 190. Accordingly, the path of movement of the lead wire 80 is stabilized, and it is possible to positively prevent the lead wire 80 from being hampered in its movement by being caught by the power window mechanims or other mechanism.

In this embodiment, the tip of the moving member 400 is formed as the curled portion 401, and arranged to be moved while maintaining the diameter of the helical portion 81 when it is shrunk. When the lead wire 80 is extended, the upper and portion of the helical portion 81 to which the operating force particularly acts is also extended, so that the problem is normally conceivable that the diameter of that portion becomes small, causing said portion to be wound tightly around the guide shaft 190. In this embodiment, however, the diameter of the upper end of the helical portion 81 remains unchanged, and this tip side is not tightly wound around the guide shaft 190, so that it is possible to positively prevent the problem of the movement of the lead wire 80 becoming hampered. In particular, since rainwater enters the door interior where the power window mechanism is disposed, even if the sliding resistance of the guide shaft 190 presents no problem during an initial period of use, it is possible that the resistance becomes large due to the attachment of dust or the like, causing the sliding of the lead wire 80 to become aggravated. Accordingly, since the lead wire 80 is moved with the diameter of the upper end being maintained by means of the curled portion 401, it is possible to positively prevent the lead wire 80 from becoming tightly wound around the guide shaft 190.

in this embodiment, since the lower end of the guide shaft 190 is curved and the lead wire 80 is accommodated in this portion at the time of shringkage, even if there is no available space below the lowermost position of movement of the motor body 61, it is possible to secure a necessary length of the lead wire 80.

In addition, in this embodiment, the arrangement is such that the output shaft of the motor body 61 (in alignment with central line P), when viewed from the moving end side of the window glass 30, is aligned with the central line of the window glass 30 in the direction of its thickness. Accordingly, distance L1 between the central line (i.e., central line P) of the window glass 30, i.e., the closure member, and the central line of the rack and pinion assembly (line R shown in FIG. 19) for producing a driving force for vertically driving the window glass 30 can be made far shorter than that of the conventional rack-and-pinion system.

As a result, the angular moment acting on the window glass 30 can be reduced substantially as compared with the conventional arrangement, and it is possible to reduce the frictional force occurring with respect to a window frame at the time of opening and closing. Hence, there is the advantage that it is possible to secure an efficient and positive opening and closing operation by arranging the motor 60 having a smaller torque than a conventional one.

This embodiment is not restricted to the above-described arrangement, and various modifications are possible within the scope of the gist of the invention.

Although in the described embodiment an arrangement for preventing a tight winding at the upper end of the helical portion 81 has been described, it is also possible to take an additional measure for preventing a tight winding at an intermediate portion of the helical portion 81.

Figure 21:
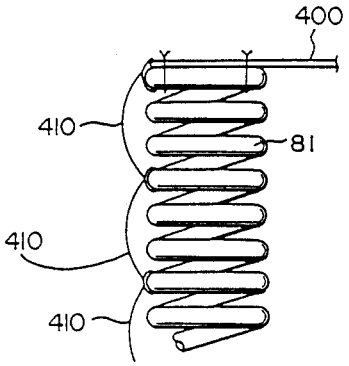
FIGS. 21 and 22 are schematic diagrams illustrating modifications in which measures are respectively adopted against a tight winding of the lead wire around the guide shaft.
Figure 22:
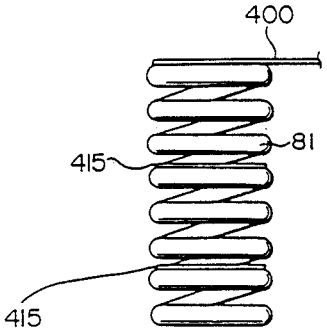

FIGS. 21 and 22 illustrate the lead wire 80 provided with the measure just mentioned. In FIG. 21, an arrangement is given in which the helical portion of the lead wire 80 is bound with coupling members 410 such as cords at specified intervals.

Thus, since the helical portion is bound at specified intervals, the operating force for moving the lead wire 80 is transmitted to not only the upper end of the lead wire 80 but also to an intermediate portion thereof, and it is possible to positively prevent the problem of a tight winding around the guide shaft 190 occurring at the intermediate helical portion.

FIG. 22 shows an arrangement in which annular members 415 such as washers are arranged in the helical portion at specified intervals, whereby the diameter of the helix of that portion is maintained by the annular members 415. In this case, since the diameter of the helical portion provided with the annular members 415 does not become smaller than that diameter, it is possible to prevent a tight winding around the guide shaft 190.

The arrangements shown in FIGS. 21 and 22 are designed to prevent a tight winding around the guide shaft 190 by devising the arrangement of the lead wire 80. In addition to this arrangement, it is also possible to make improvements on the arrangement of the guide shaft 190. As the guide shaft 190, the smaller its friction with the helical portin of the lead wire 80, the more preferable it is. For this reason, the guide shaft 190 may be provided with a Teflon coating, chromium plating, or the like.

Figure 23:
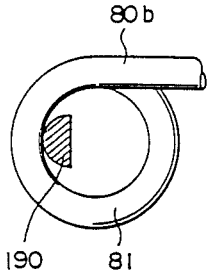
FIGS. 23 and 24 are cross-sectional views illustrating modifications of the configuration of the guide shaft.

Alternatively, the frictional force may be reduced by adopting an arrangement which, as shown in FIG. 23, adopts the gude shaft 190 with a semicircular cross section in which only the side that comes into contact with the helical portion is formed into an arcuate shape.

Figure 24:
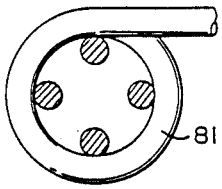

It should be noted that the movement guiding member is not restricted to the aforementioned guide shaft 190, and it is possible to adopt an arrangement in which, as shown in FIG. 24, a plurality of small-diameter rods are provided extending in the direction of movement of the motor body 61, and these rods are inserted axially through the helical portion so as to guide the movement.

In addition, the moving member 400 may be arranged integrally with the movement guiding member. For instance, an arrangement may be provided such that the movement guiding member is formed spirally as in the case of a coil spring, and the helical portion 81 of the lead wire 80 is supported by this spiral portion, thereby arranging the lead wire 80 and the movement guiding member stretchably by the action of the helixes, while the upper end of the spirally formed movement guiding member is coupled to the moving member 400, so as to offset the extending and shrinking operation. Also, an arrangement may be alternatively adopted in which the movement guiding member is formed as a stretchable guide shaft, and by coupling the upper end of the guide shaft to the moving member 400, the movement guiding member is moved to extend or shrink in correspondence with the extension or shrinkage of the lead wire 80.

Figure 25A:
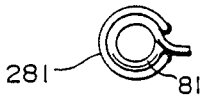
FIGS. 25A and 25B are schematic diagrams illustrating a modification of a movement guiding member.
Figure 25B:
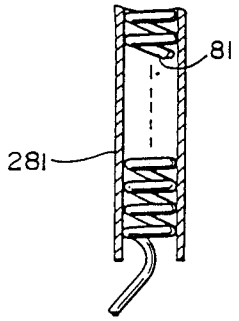

Furthermore, the movement guiding member is not necessarily restricted to the above-described one which is inserted axially through the helical portion. For instance, as shown in FIGS. 25A and 25B, the movement guiding member may be formed by a tubular member 281 covering the helical portion. In this case, a greater installation space is required than in the case of the guide shaft, and there is a problem that this arrangement can cause resonance in the door interior.

In recent years, there has been a increasing demand for mounting a self driving power window of this type on compact cars as well, and since, in this case, a relatively small current may be used, the diamter of the core of the lead wire 80 can be made small.

Figure 26:
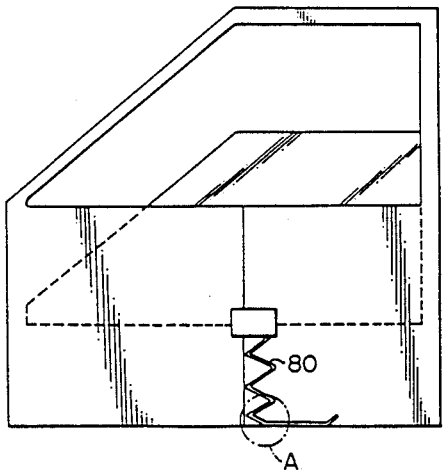
FIGS. 26 and 27 are schematic diagrams of a power supplying system as a comparative example for the present invention.

In such a case, as shown in FIG. 26, it is conceivable to adopt an arrangement in which the lead wire 80 is simply bent at specified intervals and arranged in a laminate manner, and this lead lead wire 80 is extended to follow the movement of the motor body 61.

This arrangement excels in that the moving member 400 and the movement guiding member can be dispensed with, so that the arrangement can be made simple.

Figure 27:
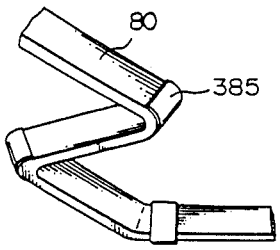
Figure 28:
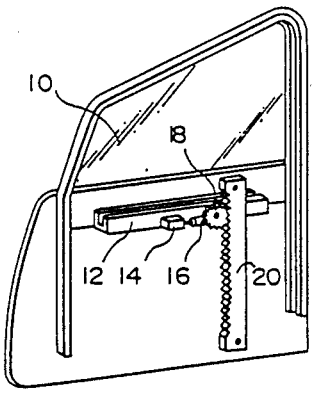
FIG. 28 PRIOR ART
FIG. 28 is a schematic diagram of a conventional power window.

However, as a meausre against disconnections caused by repeated extending and shrinking operations, it is necessary that the folded portions to be provided with rainforecments 385 such as rubber, as shown in FIG. 27 which is an enlarged view of portion A in FIG. 26. In addition, since the movement of the lead wire 80 itself is not restricted, a problem remains in that the path of its movement is not stable, and the lead wire 80 may hence be caught by a surrounding mechanism. Consequently, the present invention excels over this simple arrangement.

It should be noted that the present invention is not necessarily applicable solely to the power window, and can be applied to apparatuses in various fields in which the power driving source for opening and closing a closure member moves together with the closure member.

For instance, to cite automobiles by way of example, the present invention can be used as a power supplying system applied to the opening and closing of sun-roof panels which have found widespread use in recent years.

What is claimed is:

1. A power supplying system for a self-driving closure device in which a driving source of driving a closure member for opening and closing an opening moves together with said closure member so as to open and close said opening, said power supplying system comprising:

a lead wire having one end connected to a power source and the other end connected to said driving source;

first supporting means for supporting the side of said lead wire connected to said power source substantially at a midpoint between the positions of upper and lower limits of movement of said driving source; and second supporting means for supporting the side of said lead wire connected to said driving source in such a manner as to allow said side of said lead wire connected to said driving source to move together with said driving source;

whereby said lead wire is made swingable with a portion thereof supported by said first supporting means as a center as said driving source moves.

2. A power driving system for a closure device according to claim 1, wherein a portion of said lead wire extending between said first supporting means and said second supporting means is formed as a helical portion.

3. A power driving system for a closure device according to claim 2, wherein said helical portion is made stretchable in conjunction with the movement of said driving source.

4. A power driving system for a closure device according to claim 1, further comprising:

a guide shaft having one end rotatably supported by said first supporting means and the other end rotatably supported by said driving source, said guide shaft being adapted to support a portion of said lead wire extending between first supporting means said second supporting means; and slide means for slidably supporting a rotary supporting portion of said guide shaft on the driving source side in a direction perpendicular to the direction of movement of said driving source.

5. A power driving system for a closure device according to claim 4, wherein said lead wire is supported by being wound helically around said guide shaft.

6. A power driving system for a closure device according to claim 1, further comprising:

a guide shaft having one end rotatably supported by said first supporting means and the other end rotatably supported by the side of said driving source and made stretchable in an axial direction thereof, said guide shaft being adapted to support a portion of said lead wire extending between first supporting means and said second supporting means.

7. A power driving system for a closure device according to claim 6, wherein said lead wire is supported by being wound helically around said guide shaft.

8. A power driving system for a closure device according to claim 7, wherein said portion of said lead wire wound helically and said guide shaft are enclosed by a stretchable bellows member.

9. A power driving system for a closure device according to claim 1, wherein said self-driving closure device comprises a rack fixed to said closure member along the direction of movement of said closure device; and a pinion which is supported rotatably by said closure member, is rotatively driven by said driving source, and meshes with said rack;

10. A power driving system for a closure device according to claim 9, wherein said closure member is made movable substantiall vertically, and said driving source is constituted by a motor which is fixed to a lower portion of said closure member in such a manner that an output shaft thereof is located substantially in the same plane as the plane of movement of said closure member and is adapted to reversibly rotate said pinion via said output shaft.

11. A power supplying system for a self-driving closure device in which a driving source for driving a closure member for opening and closing an opening moves together with said closure member so as to open and close said opening, said power supplying system comprising:

a lead wire having one end connected to a power source and the other end connected to said driving source, a stretchable helcial portion being formed at an intermediate portion of said lead wire;

fixing means for fixing a side of said helical portion connected to said power source;

moving means for moving a side of said helical portion connected to said driving source together with said driving source while the diameter of said end of said helical portion connected to said driving source is being maintained in such a manner as not to become small; and guide means for guiding said helical portion which is moved by said moving means.

12. A power driving system for a closure device according to claim 11, wherein said moving means has a curled portion curved in such a manner that the diameter of said curled portion becomes substantially identical with the diameter of said helical portion.

13. A power driving system for a closure device according to claim 11, wherein said guide means has a straight portion extending along the direction of movement of said driving source and also serves as a guide shaft inserted axially through said helical portion.

14. A power driving system for a closure device according to claim 13, wherein said guide shaft is provided with a curved portion for holding said helical portion of said lead wire, said curved portion being provided continuously from said straight portion.

15. A power driving system for a closure device according to claim 11, wherein said helical portion of said lead wire is bound by a plurality of binding members at predetermined intervals.

16. A power driving system for a closure device according to claim 11, wherein said helical portion of said lead wire is provided with a plurality of annular members for maintaining the diameter of said helical portion in such a manner that said diameter will not become small, said plurality of annular members being disposed at specified intervals.

17. A power driving system for a closure device according to claim 11, wherein a curved surface is formed at a portion of said guide means that comes into contact with said helical portion.

18. A power driving system for a closure device according to claim 11, wherein said guide means is constituted by a plurality of rods extending along the direction of movement of said driving source.

19. A power driving system for a closure device according to claim 11, wherein said self-driving closure device comprises a rack fixed to said closure member along the direction of movement of said closure device; and a pinion which is supported rotatably by said closure member, is rotatively driven by said driving source, and meshes with said rack;

20. A power driving system for a closure device according to claim 11, wherein said closure member is made movable substantially vertically, and said driving source is constituted by a motor which is fixed to a lower portion of said closure member in such a manner that an output shaft thereof is located substantially in the same plane as the plane of movement of said closure member and is adapted to reversibly rotate said pinion via said output shaft.

* * * * *

UNITED STATES PATENT AND TRADEMARK OFFICE

CERTIFICATE OF CORRECTION

PATENT NO. : 4,939,867

DATED : July 10, 1990

INVENTOR(S) : Hiroyuki Harada et al.

It is certified that error appears in the above-identified patent and that said Letters Patent is hereby corrected as shown below:

On the title page of the patent, the name of the first assignee should be corrected to read --Asmo Co., Ltd.--.

Signed and Sealed this

Third Day of March, 1992

*Attest:*

HARRY F. MANBECK, JR.

*Attesting Officer*

*Commissioner of Patents and Trademarks*